United States Patent [19]

Shroyer

[11] Patent Number: 4,955,178

[45] **Date of Patent: * Sep. 11, 1990**

[54] ALIGNMENT APPARATUS WITH GATED OUTPUT FOR IMPACT ALIGNMENT OF WEIGHED BATCHES OF ELONGATED OBJECTS

[75] Inventor: David Shroyer, Richland, Wash.

[73] Assignee: Lamb-Weston, Inc., Richland, Wash.

[ * ] Notice: The portion of the term of this patent subsequent to Jul. 4, 2006 has been disclaimed.

[21] Appl. No.: 397,008

[22] Filed: Aug. 22, 1989

[51] Int. Cl.[5] ..... B65B 1/22; B65B 35/32; B65B 65/08; B65G 47/14

[52] U.S. Cl. ..... 53/148; 53/167; 53/236; 53/525; 53/540; 53/544; 198/396; 198/418.6

[58] Field of Search ..... 53/148, 167, 236, 502, 53/525, 544, 531, 540; 198/396, 400, 560, 418.6, 532, 533, 956; 221/172

[56] References Cited

U.S. PATENT DOCUMENTS

| | | | |
|---|---|---|---|
| 3,842,569 | 10/1974 | McClelland, et al. | 53/37 |
| 4,019,547 | 4/1977 | Ross | 53/525 X |
| 4,054,015 | 10/1977 | Rowell | 53/544 X |
| 4,220,238 | 9/1980 | Shavit | 198/400 |
| 4,514,959 | 5/1985 | Shroyer | 53/428 |
| 4,520,614 | 6/1985 | Aykut et al. | 53/540 |
| 4,586,313 | 5/1986 | Maglecic | 53/446 X |
| 4,607,478 | 8/1986 | Maglecic | 53/502 |
| 4,629,017 | 12/1986 | Shroyer | 177/25 |
| 4,693,355 | 9/1987 | Bochi, et al. | 193/2 R |
| 4,843,795 | 7/1989 | Shroyer | 53/236 |

*Primary Examiner*—Robert L. Spruill
*Assistant Examiner*—Beth Bianca
*Attorney, Agent, or Firm*—Klarquist, Sparkman, Capmbell, Leigh & Whinston

[57] ABSTRACT

An alignment apparatus is disclosed for aligning weighed batches or elongated objects, such as French-Fried potato strips. The batch of objects is weighed in a scale and discharged onto a moving conveyor belt which separates the objects and projects such objects from the conveyor into a vibrated alignment container including a first container means having a curved deflector wall and a second container means with a gated discharge outlet. The objects impact a vertically-curved rear deflector wall of the first alignment container means in a direction substantially perpendicular thereto and may fall into contact with a straight front deflector wall so that they are aligned substantially parallel to such rear wall when they fall into the supply inlet of a second container means. The second container means if a rectangular tube having a gate at its discharge outlet which is normally closed. The objects are further aligned and compacted in the container tube and are discharged by opening the gate as a batch of aligned objects of small size and predetermined weight into a packaging machine which packages the weighed batch of aligned objects.

19 Claims, 1 Drawing Sheet

ALIGNMENT APPARATUS WITH GATED OUTPUT FOR IMPACT ALIGNMENT OF WEIGHED BATCHES OF ELONGATED OBJECTS

BACKGROUND OF THE INVENTION

The subject matter of the present invention relates generally to alignment apparatus for the alignment of elongated objects, and in particular, to such apparatus which employs impact alignment to align weighed batches of elongated objects prior to packaging. The present invention employs an alignment container with a curved impact wall and a gated discharge output, and is an improvement on the alignment apparatus shown in U.S. Pat. No. 4,843,795 issued July 4, 1989 to David Shroyer in that it produces a more compact package of the same weight of comparable objects. The alignment apparatus of the present invention is especially useful in aligning and packaging elongated food products, including French-fried potato strips.

An alignment apparatus is disclosed in U.S. Pat. No. 4,514,959 issued May 7, 1985 to Shroyer for aligning elongated objects by transmitting such objects along channels on a vibrating conveyor to partially align such objects before they contact the rear wall of an alignment container so that such objects strike such rear wall with their longitudinal axis at an acute angle. The elongated objects are thereby aligned substantially parallel to the rear wall of the alignment container and fall into such container where they are vibrated for further alignment and compaction until they reach a predetermined weight and are discharged as a weighed batch from the alignment container into a packaging machine. The present invention is faster, less expensive, and of more trouble-free operation than such prior apparatus while also being simpler and less expensive to manufacture. The present alignment apparatus differs therefrom by employing a conventional belt conveyor on which weighed batches of elongated objects are deposited and are caused to become separated by stream-out as they fall onto the moving belt conveyor, such objects being thrown off the end of the conveyor into impact with the curved rear deflector wall of a vibrated first alignment container portion in a substantially perpendicular direction. The elongated objects then may fall into contact with a straight front deflector wall and the majority of such objects are caused by such first alignment container portion to be aligned substantially parallel with the rear wall of the alignment container when they drop from such first alignment container into a second alignment container portion which may be a rectangular tube. The elongated objects fill such tube and are further aligned and compacted before being discharged as a batch of aligned objects by opening a gate at the discharge outlet of such tube which causes them to fall into a packaging machine where they are packaged as a weighed batch of aligned objects.

As is shown in U.S. Pat. No. 4,607,478, granted Aug. 26, 1986, and U.S. Pat. No. 4,586,313, granted May 6, 1986, to Steven C. Maglecic, it has previously been proposed to provide an alignment apparatus for packaging elongated objects after they are caused to free-fall through a tube, resulting in separation and partial alignment. However, these patents do not show impact alignment of elongated objects by projecting such objects off a rapidly-moving conveyor belt into impact contact with the rear wall of an alignment container in the manner of the present invention. In addition, it has been proposed to provide an automatic weighing apparatus for weighing batches of objects as shown in U.S. Pat. No. 4,693,355 of Bochi, et al., issued Sept. 15, 1987. Also, it is old to provide an apparatus for orienting randomly-distributed objects of a known shape, such as bottles or ampules, using a vibratory conveyor and an orienting device, as shown in U.S. Pat. No. 4,220,238 of Shavit, issued Sept. 2, 1980. Finally, it is known to provide an automatic bagging apparatus for bagging batches of elongated food products, as shown in U.S. Pat. No. 3,842,569 of McClelland, et al., issued Oct. 22, 1974. However, none of these prior art apparatus employ an alignment apparatus for impact alignment of elongated objects by projecting weighed batches of such objects off the end of a rapidly-moving conveyor belt into impact with the curved rear wall of a first vibrated alignment container means and for further alignment and compaction by dropping such objects into a second vibrated container means having a gated discharge outlet in the manner of the present invention.

The present invention has several advantages over prior alignment apparatus, including fast, trouble-free operation which has less jam-ups. In addition, such invention produces packages of weighed batches of aligned, elongated articles which are more compact so they occupy from 10 to 14 percent less volume than prior packages of the same weight, and are of a more uniform predetermined weight. Also, the present alignment apparatus is simpler and less expensive to manufacture than prior apparatus of this type.

SUMMARY OF THE INVENTION

It is, therefore, one object of the present invention to provide an improved alignment apparatus for aligning elongated objects in a fast, trouble-free manner which is less subject to jam-ups.

Another object of the invention is to provide such an improved alignment apparatus in which weighed batches of elongated objects are deposited on a moving belt conveyor and conveyed rapidly down such conveyor to separate such objects and to project them into impact with a deflector wall of an alignment container for causing such objects to become substantially aligned before they are discharged from such container.

An additional object of the invention is to provide such an alignment apparatus which produces batches of aligned elongated objects that are more compact and are of a more accurate predetermined weight so they may be packaged in more uniform weight packages of smaller size.

Still another object of the invention is to provide such an alignment apparatus in which the elongated objects are projected in a direction substantially perpendicular to a vertically-curved rear wall of a first alignment container portion, such objects having a random orientation when they strike the rear wall of the alignment container, and leaving such first container portion aligned substantially parallel to such rear wall.

A still further object of the invention is to provide such an alignment apparatus in which the aligned articles are discharged from the first alignment container portion into a second alignment container portion having a gated discharge outlet for further alignment and compaction of such articles in said second container portion prior to packaging.

DESCRIPTION OF THE DRAWINGS

Other objects and advantages of the present invention will be apparent from the following detailed description of a preferred embodiment thereof, of which.

DESCRIPTION OF PREFERRED EMBODIMENT

Figures 1, 2:
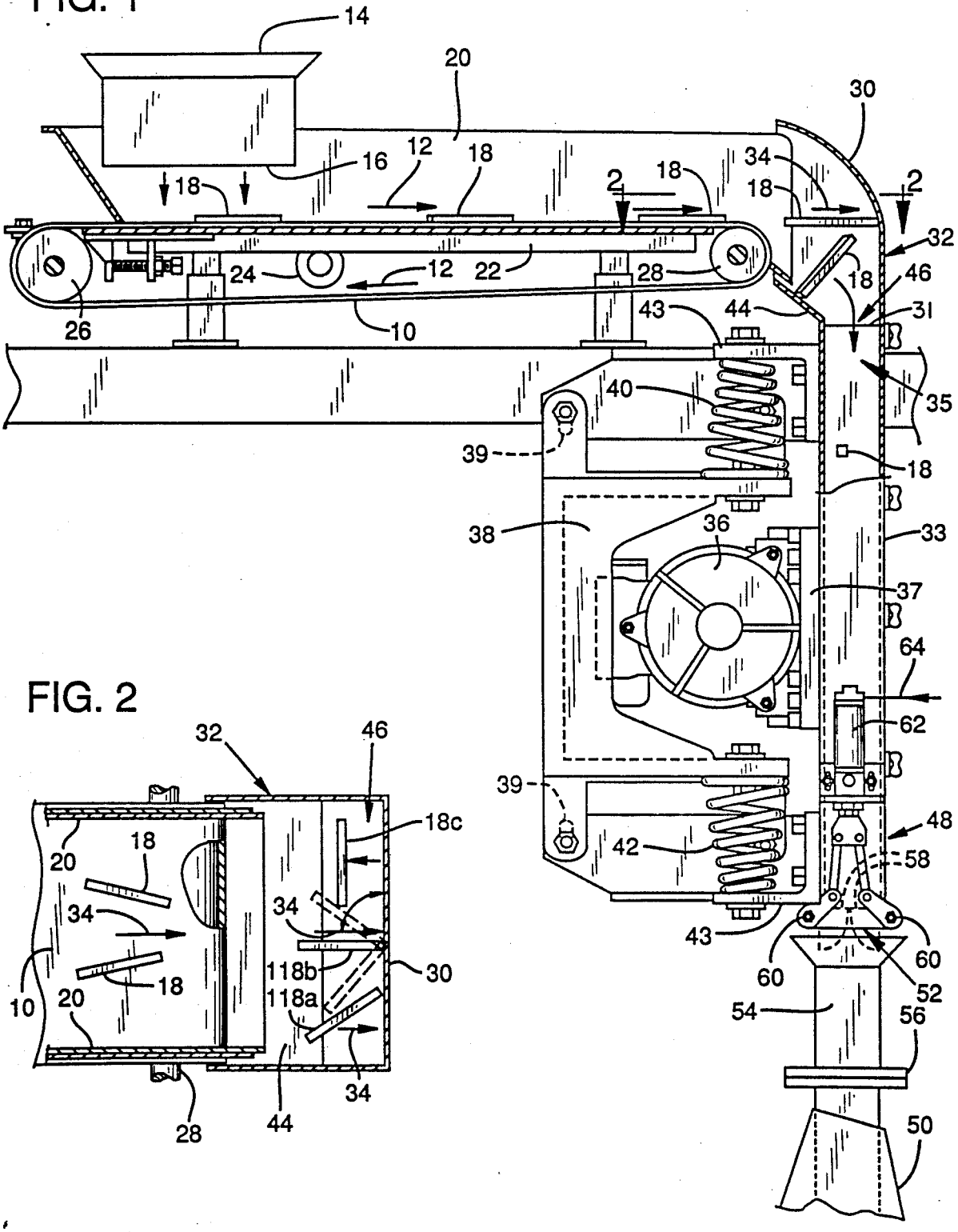
FIG. 1 is a longitudinal section view through the alignment apparatus of the present invention.
FIG. 2 is an enlarged horizontal section view taken along the line 2—2 of FIG. 1 showing the operation of the alignment container.

As shown in FIGS. 1 and 2, the alignment apparatus of the present invention includes a belt conveyor 10 which rotates at a speed of up to approximately 300 feet per minute in the counterclockwise direction shown by arrows 12. A batch of elongated objects 18, such as French-fried potato strips or other food products, is weighed in a scale 14 and discharged through a gate 16 at the outlet of such scale to deposit such elongated objects 18 onto the top of the moving conveyor belt. As the objects fall upon the conveyor belt, they are separated by the streaming-out action of the conveyor belt to provide spaced and separated objects 18. A pair of conveyor side members 20 is fixedly mounted on opposite sides of the conveyor belt to form therewith a trough which maintains the elongated objects on the conveyor belt, such belt transporting the objects over a belt support plate 22 at the bottom of such trough. The conveyor belt is driven by a motor 24 whose output shaft is coupled by a chain to an input roller 26 at the input end of the belt and/or to an output roller 28 at the output end of such belt, as shown in FIG. 1.

As shown in FIG. 1, when the elongated objects 18 are transported by the conveyor belt 10 past the output roller 28, they are projected off the end of the belt at a high speed of about 250 to 300 feet per minute into contact with a vertically-curved rear deflector wall 30 of a first container portion 32 of an alignment container. As shown in FIG. 2, the elongated objects, such as French-fried potato strips 18, are all projected from the end of conveyor belt 10 in a direction 34 substantially perpendicular to the rear wall 30 of the first alignment container portion 32. However, such elongated objects are of a random orientation when they leave the conveyor belt before they strike the rear wall 30, as shown by objects 18A and 18B in FIG. 2.

A second alignment container portion 33 which may be in the form of a tube having a rectangular cross section of about 2.5 by 12.0 inches, has its supply inlet 35 at the top of such tube aligned with the outlet opening 46 of the first container portion 30. The inlet end of tube 33 may be spaced from the outlet of the first container portion 30, but is preferably connected thereto, such as by a welded connection 31. A discharge outlet 52 at the bottom of the second container tube 33 is normally closed by a cylinder-actuated gate 48 in a manner hereafter described to enable the tube to be filled with elongated objects 18 which are dropped into such tube from the first container portion 32. When the gate 48 is opened the elongated objects 18 fall as a batch of aligned and compacted objects through the discharge outlet of the container tube 33 into a conventional packaging machine 50.

The first alignment container 32 and the second container tube 33 are both vibrated at a frequency of about 1300 to 1800 cps by a vibrational motor 36 attached to a bracket 37 on the side of the alignment tube. The alignment container tube 33 and alignment container portion 32 are both resiliently mounted on U-shaped support 38 fixed to the frame, as shown in FIG. 1. Thus, the alignment container tube 33 is mounted on springs 40 and 42 which are held between brackets 43 fixed to such tube and the arms of support 38 at the top and bottom, respectively, of such container tube. The brackets 43 for the tube 33 are each also loosely connected by an elongated slot 39 and associated bolt extending through such slot to mounting projection on the support to restrict vibrational movement of the tube 33 and container 32 to a vertical plane and to prevent horizontal movement perpendicular to such plane.

As shown in FIG. 1, the first alignment container portion 32 includes a straight front deflector wall 44 which is inclined at an angle of approximately 45 degrees and is positioned below the vertically-curved rear wall 30 so that elongated objects striking such rear wall fall downward and may also strike the front wall 44. This causes the elongated objects to become aligned substantially parallel with the rear wall upon discharge of such objects through the outlet opening 46 of such alignment container, as shown by object 18C in FIG. 2.

The second alignment container portion formed by tube 33 is positioned below with its supply inlet 35 in alignment with the outlet opening 46 of the first alignment container 32. As a result, the aligned objects 18, discharged from the outlet opening 46 of the first alignment container, fall into the container tube 33, and fill such tube when the discharge gate 48 closes the discharge outlet 52 at the bottom of such tube. The vibration of the second container tube 33 causes further alignment of the objects within such tube with the majority having their longitudinal dimensions substantially horizontal and parallel to the rear wall of the rectangular container tube 33 so that a batch of aligned and compacted objects is formed in such tube.

The gate 48 includes two gate doors 58 pivoted at hinges 60 to normally close the discharge outlet 52 of tube 33. The gate is operated by an air cylinder 62 in response to a control signal 64 which opens and closes a valve connected to such cylinder. Thus the gate 48 is opened by the cylinder 62 in order to discharge the batch of aligned objects through the discharge outlet 52 of the container tube 33. The batch of objects is discharged into a packaging mechanism 50 of conventional type, such as that shown in U.S. Pat. No. 4,514,959 of Shroyer. Thus, the elongated objects 18 fall from tube 33 through a transfer tube 54 into the packaging mechanism 50, such transfer tube being connected by a coupling 56 to the end of the input tube of the packaging machine 50. The objects leaving the alignment tube 33 at outlet opening 52 are compacted into a batch of aligned elongated objects of predetermined weight which are packaged into a package of small size about 10 to 14 percent less volume than prior apparatus by the packaging mechanism 50.

It will be obvious to those having ordinary skill in the art that many changes may be made in the above-described details of the preferred embodiment of the present invention without departing from the spirit of the invention. Therefore, the scope of the present invention should be determined by the following claims.

I claim:

1. Alignment apparatus for impact alignment of elongated objects, comprising:

alignment means for aligning said elongated objects, including an alignment container means with a first container means having an inlet opening, an outlet opening, and a curved deflector wall, a second container means having a supply inlet aligned with the outlet opening of said first container means and having a discharge outlet, and gate mans for closing said discharge outlet as said second container means is being filled with elongated objects and for opening said discharge outlet to empty said second container means of said elongated objects;

conveyor means for conveying elongated objects and for projecting said objects from said conveyor through the inlet opening of the first container means of the alignment container in a direction toward the curved deflector wall to cause said objects to strike said curved wall and to be deflected by the impact; and vibrator means for vibrating said alignment container means to cause a majority of the elongated objects to be aligned into a compact batch of said objects in said second container portion which is discharged from said discharge outlet.

2. Alignment apparatus in accordance with claim 1 which also includes feeder means for feeding said elongated objects onto a moving conveyor belt forming said conveyor means in batches of objects of predetermined amounts.

3. Alignment apparatus in accordance with claim 2 in which the feeder means includes scale means for weighing said batches before they are fed onto the conveyor.

4. Alignment apparatus in accordance with claim 3 in which feeder means feeds the batches onto the conveyor means in a manner to cause the objects of each batch to become separated and spaced along said conveyor.

5. Alignment apparatus in accordance with claim 1 in which the second container means is a rectangular tube means whose top end is coupled to the outlet opening of the first container means for receiving elongated objects from said outlet opening and causing said objects to be compacted into a batch of aligned objects in said tube means when the gate means is closed and to discharge said batch of objects from the bottom end of said tube means when said gate means is open.

6. Alignment apparatus in accordance with claim 5 which also includes packaging means for packaging the batch of aligned objects, said bottom end of said conduit discharging said objects into said packaging means.

7. Alignment apparatus in accordance with claim 1 in which the first container means has a vertically-curved deflector wall positioned above a straight deflector wall so that objects deflected by the curved wall may also strike the straight wall.

8. Alignment apparatus in accordance with claim 1 in which the curved deflector wall is curved vertically to provide a concave curved vertical surface against which the elongated objects are projected by the conveyor means.

9. Alignment apparatus in accordance with claim 1 in which the vibrator means includes a common vibrator for vibrating both said first container means and said second container means.

10. Alignment apparatus for impact alignment of elongated objects, comprising:

alignment means for aligning said elongated objects, including an alignment container means with a first container means having an inlet opening, an outlet opening, and a vertically-curved deflector wall, a second container means having a supply inlet aligned with the outlet opening of said first container means and having a discharge outlet;

gate means for closing said discharge outlet when said second container means is being filled with said elongated objects and for opening said discharge outlet to empty said second container means; and conveyor means for conveying elongated objects and for projecting said objects from said conveyor through the inlet opening of the alignment container in a direction which is substantially perpendicular to the curved deflector wall to cause said objects to strike said curved wall and to be deflected by the impact and discharged from said outlet opening.

11. Alignment apparatus in accordance with claim 10 which also includes feeder means for feeding said elongated objects onto said conveyor means in batches of objects of predetermined amounts.

12. Alignment apparatus in accordance with claim 11 in which the feeder means includes scale means for weighing said batches before they are fed onto the conveyor.

13. Alignment apparatus in accordance with claim 12 in which feeder means feeds the batches onto the conveyor means in a manner to cause the objects of each batch to be spaced along said conveyor.

14. Alignment apparatus in accordance with claim 10, which also includes vibrator means for vibrating said alignment container means to cause the elongated objects to be aligned substantially parallel when they are discharged from said discharge outlet at the bottom of said second container means.

15. Alignment apparatus in accordance with claim 10 which also includes packaging means for packaging the aligned objects, said discharge outlet of said second container means discharging said objects into said packaging means.

16. Alignment apparatus in accordance with claim 10 in which the first container means has the curved deflector wall positioned above a straight deflector wall so that the objects deflected by the curved wall may also strike the straight wall.

17. Alignment apparatus in accordance with claim 10 in which the curved deflector wall is curved vertically to provide a concave curved vertical surface against which the elongated objects are projected by the conveyor means.

18. Alignment apparatus in accordance with claim 4 in which the vibrator means is common for vibrating both said first container means and said second container means.

19. Alignment apparatus in accordance with claim 10 in which the elongated objects are french fry potato strips.

* * * * *